US011786424B2

(12) United States Patent
Morgan et al.

(10) Patent No.: US 11,786,424 B2
(45) Date of Patent: Oct. 17, 2023

(54) WHEEL CHAIR RIGGING HOLDER

(71) Applicant: Direct Supply, Inc., Milwaukee, WI (US)

(72) Inventors: Justin Morgan, Cedarburg, WI (US); Anthony Patrick, Delafield, WI (US); Joshua Jakubowski, Port Washington, WI (US)

(73) Assignee: Direct Supply, Inc., Milwaukee, WI (US)

( * ) Notice: Subject to any disclaimer, the term of this patent is extended or adjusted under 35 U.S.C. 154(b) by 1073 days.

(21) Appl. No.: 16/564,588

(22) Filed: Sep. 9, 2019

(65) Prior Publication Data

US 2020/0078236 A1 Mar. 12, 2020

Related U.S. Application Data

(60) Provisional application No. 62/728,561, filed on Sep. 7, 2018.

(51) Int. Cl.

| | |
|---|---|
| ***A61G 5/12*** | (2006.01) |
| ***A61G 5/10*** | (2006.01) |
| *A61G 5/08* | (2006.01) |

(52) U.S. Cl.

CPC ..... *A61G 5/128* (2016.11); *A61G 5/1056* (2013.01); *A61G 5/08* (2013.01); *A61G 5/1089* (2016.11)

(58) Field of Classification Search

CPC ..... A61G 5/128; A61G 5/1056

See application file for complete search history.

(56) References Cited

U.S. PATENT DOCUMENTS

| | | | | |
|---|---|---|---|---|
| 4,213,648 | A | 7/1980 | Steichen | |
| 4,431,206 | A | 2/1984 | Pryor | |
| 4,577,903 | A * | 3/1986 | Wells | A61G 5/10 224/407 |
| D305,629 | S | 1/1990 | Wood | |
| 5,154,331 | A * | 10/1992 | Sanders | A61G 5/10 224/407 |
| 5,340,140 | A | 8/1994 | Bynum | |
| 7,648,113 | B2 | 1/2010 | Johnson | |

(Continued)

FOREIGN PATENT DOCUMENTS

| | | |
|---|---|---|
| WO | 2013188814 | 12/2013 |

*Primary Examiner* — Minnah L Seoh
*Assistant Examiner* — Ryan Edward Hardy
(74) *Attorney, Agent, or Firm* — Boyle Fredrickson, S.C.

(57) ABSTRACT

The present invention provides an assembly having a wheelchair and a wheelchair rigging receptacle. The wheelchair may include an appendage support rigging that is releasably affixed to the frame and configured to support a user's appendage, e.g. foot, when in use. The assembly also provides at least one receptacle configured to retain the appendage support rigging within, when the appendage support rigging is not affixed to the frame. The receptacle may comprise two opposing flexible side walls, a rear wall extending between the side walls, and a bottom extending between a lower edge of the walls to define an interior cavity between an inner surface of the wall and the base that has a width approximately equal to a width of the appendage support rigging. The receptacle also includes at least one mounting device to affix the receptacle to the anti-tip bar of the wheelchair at the rear of the seating surface.

18 Claims, 5 Drawing Sheets

(56) References Cited

U.S. PATENT DOCUMENTS

| | | | | |
|---|---|---|---|---|
| 8,328,220 | B1 * | 12/2012 | Kern | A61G 5/1054 280/647 |
| 8,608,038 | B2 | 12/2013 | Katchen et al. | |
| 2006/0102670 | A1 * | 5/2006 | Hassett | A61G 5/10 224/407 |
| 2008/0067207 | A1 * | 3/2008 | Behrhorst | A61G 5/1054 224/407 |
| 2008/0156838 | A1 * | 7/2008 | Johnson | A61G 5/10 224/407 |
| 2015/0224003 | A1 * | 8/2015 | Allen | A61G 5/1094 297/188.06 |
| 2017/0273839 | A1 * | 9/2017 | Itano | A61G 5/02 |
| 2018/0035769 | A1 * | 2/2018 | Wilber | A45B 3/10 |
| 2019/0191856 | A1 * | 6/2019 | Didierjean | A45F 4/02 |
| 2019/0350394 | A1 * | 11/2019 | Jones | A47G 23/0216 |

* cited by examiner

WHEEL CHAIR RIGGING HOLDER

CROSS REFERENCE TO RELATED APPLICATION

This application claims priority to U.S. Provisional Patent Application Ser. No. 62/728,561 filed on Sep. 7, 2018, the entirety of which is incorporated herein by reference

BACKGROUND OF THE INVENTION

The present invention relates to an accessory carrier for use with a conventional collapsible wheelchair; and more specifically, relates to a carrier configured to retain a removable wheelchair rigging on the back side of a wheelchair when the rigging is not in use.

Conventional collapsible wheelchairs are commonly used to accommodate a variety of individual users, as well as intended to accommodate the different medical needs of those individuals. For example, some users may require additional appendage support when using a wheelchair, while others may not. For this reason, removable appendage support structures, often referred to as riggings, have been developed that integrate with the wheelchair and provide additional structural support when required. Common examples of such riggings include removable footrests, e.g., foot plates, elevating leg rests, etc. However, because these riggings are not required for all wheelchair users, particularly in institutional settings where wheelchairs are commonly shared among many users, the riggings may be selectively removed from the wheelchair when they are not required. Further, some wheelchair users require the use of riggings at sometimes but at other times require the riggings to be removed from the front of the chair. For example, a user may use riggings typically but must remove them during meals in order to fit their chair and occupant into a standard dining table.

Removal of wheelchair riggings often results in the riggings becoming misplaced or stored separately from the wheelchair, where their retrieval is inconvenient. Also, because wheelchair structure and dimensions vary amongst differing models or manufacturers, the riggings may not be universally interchangeable amongst all wheelchairs. For these reasons, it is desirable to keep the rigging associated with a specific wheelchair, even when that rigging is not being used, or during a temporary i.e., relatively short duration, removal of the rigging.

Prior attempts to solve this problem have included hanging rigging storage bags on the back of the wheelchair. However, when these bags are used, they often swing into the back of the seated wheelchair user or impede the lower leg movement of the individual pushing the wheelchair from the rear. Accordingly, an ergonomic rigging storage solution is needed. Additionally, such bags or alternative storage solutions may inhibit a conventional collapsible wheelchair from folding inward for storage purposes. Accordingly, a rigging storage solution that does not prevent folding of a collapsible wheelchair is also needed.

SUMMARY OF THE INVENTION

The present inventors have recognized that that by affixing a receptacle that this sized to securely retain an unused appendage support rigging directly to the rear of the wheelchair it is possible to retain the unused rigging in association to its corresponding wheelchair, while not occupying both opposing sides at the rear of the wheelchair. By reducing the width of the receptacle, the invention allows for multiple receptacles to be secured to the rear of the wheelchair, or for a single receptacle to be mounted to the wheelchair in combination with a compressed gas cylinder, e.g., oxygen tank. Importantly, the size and attachment positioning of receptacle does not substantially reduce the ability of a collapsible wheelchair to collapse when two receptacles are mounted to its opposing sides; i.e., a wheelchair having two receptacles may still collapse to greater than 75% of its fully collapsed configuration.

Specifically the, in one embodiment, the present invention provides an assembly having a wheelchair and a wheelchair rigging receptacle. The wheelchair includes a frame with opposing first and second sides where a first wheel rotatably affixed to a first side and a second wheel rotatably affixed to a second side. The first side of the frame includes a first vertical tube and a first horizontal tube extending rearwardly of the first vertical tube while the second side of the frame includes a second vertical tube and a second horizontal tube extending rearwardly of the second vertical tube. A seating surface extends between the first and second sides of the frame and an appendage support rigging is releasably affixed to the frame. The assembly also provides at least one receptacle configured to retain the appendage support rigging within, when the appendage support rigging is not affixed to the frame. The receptacle has two opposing side walls, a rear wall extending between the two opposing side walls, and a bottom extending between a lower edge of the walls to define an interior cavity between an inner surface of the wall and the base that has a width approximately equal to a width of the appendage support rigging. The receptacle also includes at least one mounting device to affix the receptacle to the frame of the wheelchair.

It is thus a feature of at least one embodiment of the invention to provide a wheelchair assembly including at least one receptacle having an internal cavity into which an unused appendage support rigging can be slid, through an open top surface, when the appendage support rigging is not affixed to the frame.

The receptacle of the assembly may have a width less than or equal to half the width of the wheelchair frame.

It is thus a feature of at least one embodiment of the invention to provide an assembly in which two receptacles are mounted to the wheelchair.

The wheelchair of the assembly may be a collapsible wheelchair and the receptacle of the assembly may have a width less than or equal to 60% of the width of the collapsible wheelchair frame.

It is thus a feature of at least one embodiment of the invention to allow a collapsible wheelchair having two mounted receptacles to collapse to at least 75% of its fully collapsed configuration.

The receptacle of the assembly may have walls and the base comprise a semirigid core disposed within a foam pad.

It is thus a feature of at least one embodiment of the invention to provide flexible and/or resilient walls that are configured to deform about the unused appendage support rigging as to provide a friction engagement to retain the rigging within the receptacle's interior cavity.

The receptacle of the assembly may include outer surfaces of each wall that are formed of a fluid resistant fabric.

It is thus a feature of at least one embodiment of the invention to provide a fluid resistant receptacle that can easily be washed and resists absorption of fluids.

The receptacle of the assembly may include at least one drain grommet in the base.

It is thus a feature of at least one embodiment of the invention to provide a fluid drain in the bottom of the receptacle to facilitate drying of the interior cavity.

The receptacle of the assembly may include a first mounting device configured to secure the rear wall of the receptacle to a vertical tube of the wheel chair frame at a variable position over a height of the receptacle's rear wall.

It is thus a feature of at least one embodiment of the invention to provide a receptacle that can be securely mounted to the vertical tube of wheelchairs of varying dimensions.

The receptacle of the assembly may include a second mounting device configured to secure the base of the receptacle to a horizontal tube of the wheel chair frame at a variable position over a length of the receptacle's base.

It is thus a feature of at least one embodiment of the invention to provide a receptacle that can be securely mounted to the horizontal tube of wheelchairs of varying dimensions.

These particular advantages may apply to only some embodiments falling within the claims and thus do not define the scope of the invention.

DETAILED DESCRIPTION OF THE PREFERRED EMBODIMENT

Figures 1, 2:
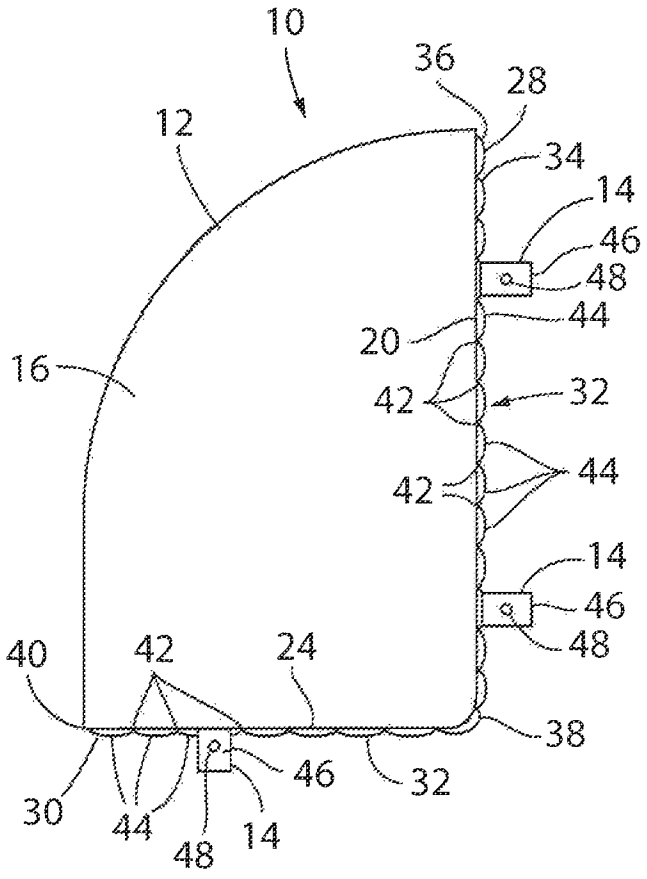
FIG. 1 is front side perspective view of the rigging carrier in accordance with one embodiment of the present invention.
FIG. 2 is side elevation view of the rigging carrier shown in FIG. 1.

Referring to FIGS. 1-6, and initially FIG. 1, in one embodiment, the present invention provides a rigging carrier 10 or holder including a receptacle 12 configured for receiving a wheelchair rigging therein and one or more mounting devices 14 for mounting the receptacle 12 to the wheelchair as will be described in further detail below.

The receptacle 12 may include a first side wall 16, a second opposing side wall 18, a rear wall 20, a front wall 22, and a bottom 24 that extends between the lower edges of the walls 16, 18, 20, 22. The sidewalls 16, 18 may have two perpendicular edges of different lengths that will be positioned vertically and horizontally respectively as spanned by a convex are for example following a circular path. The vertical edge will generally be longer than the horizontal edge.

The side walls 16, 18 are spaced apart from one another at a width approximately equal to that of the rear wall 20 and front wall 22, which is approximately equal to the width of a folded wheelchair rigging, such that a folded wheelchair rigging may be securely placed into an internal cavity 26 defined between the receptacle's opposing walls 16, 18, 20, 22 and bottom 24 and retained in frictional engagement therein. Furthermore, the width of the receptacle 12 may be sufficiently narrow as to prevent the receptacle 12 from impeding or inhibiting the folding mechanism of a conventional collapsible wheelchair alone or when two receptacles 12 are mounted near opposite wheels of the wheelchair. For example, the receptacle 12 may have a width approximately between 2.0 inches and 5.0 inches, and preferably approximately 3.5 inches. The side walls may also have a height and length configured to securely retain the folded wheel chair rigging between the receptacle's opposing side walls 16, 18. Further, the receptacle 12 may have a greater height at or near the rear wall 20 of approximately between 10.0 inches and 24.0 inches, and preferable approximately 16.0 inches. As shown in FIG. 1, the front wall 22 may have a height that is less than that of the rear wall 20; namely, of approximately between 10.0 inches and 20.0 inches, and preferably approximately 13.0 inches. As shown in FIG. 1, the side walls 16, 18 may curve from the greater height at or near the rear wall 20 to the lesser height at or near the front wall 22; however, it should be understood that the present invention is not limited to such a construction and that alternatively shaped side walls 16, 18 are well within the scope of the current invention. Additionally, by way of example the receptacle 12 may have a length, i.e., the distance between the rear wall 20 and front wall 22 of approximately between 6.0 inches and 15.0 inches, and preferable approximately 11.0 inches.

Collectively, the width, height and length of the receptacle 12 are preferably sized as to securely retain a folded wheelchair rigging, e.g. a removable footplate rigging, in a cavity 26 defined between at least some of the receptacle's opposing walls 16, 18, 20, 22, while simultaneously not impede or inhibit the folding mechanism of a conventional collapsible wheelchair. Furthermore, in one embodiment of the present invention, the width of the receptacle 12 is approximately half of the distance between the wheels of the wheelchair, when the wheelchair is in a collapsed configuration, such that two rigging carriers 10 may be simultaneously mounted to the wheelchair. For example, the receptacle 12 may have a width that provides approximately 75% to 100% closure of the wheelchair into its fully collapsed configuration when two rigging carriers 10 are simultaneously mounted to the wheelchair, and preferably approximately 90% to 100% closure of the wheelchair into its fully collapsed configuration when two rigging carriers 10 are simultaneously mounted to the wheelchair.

Figure 7:
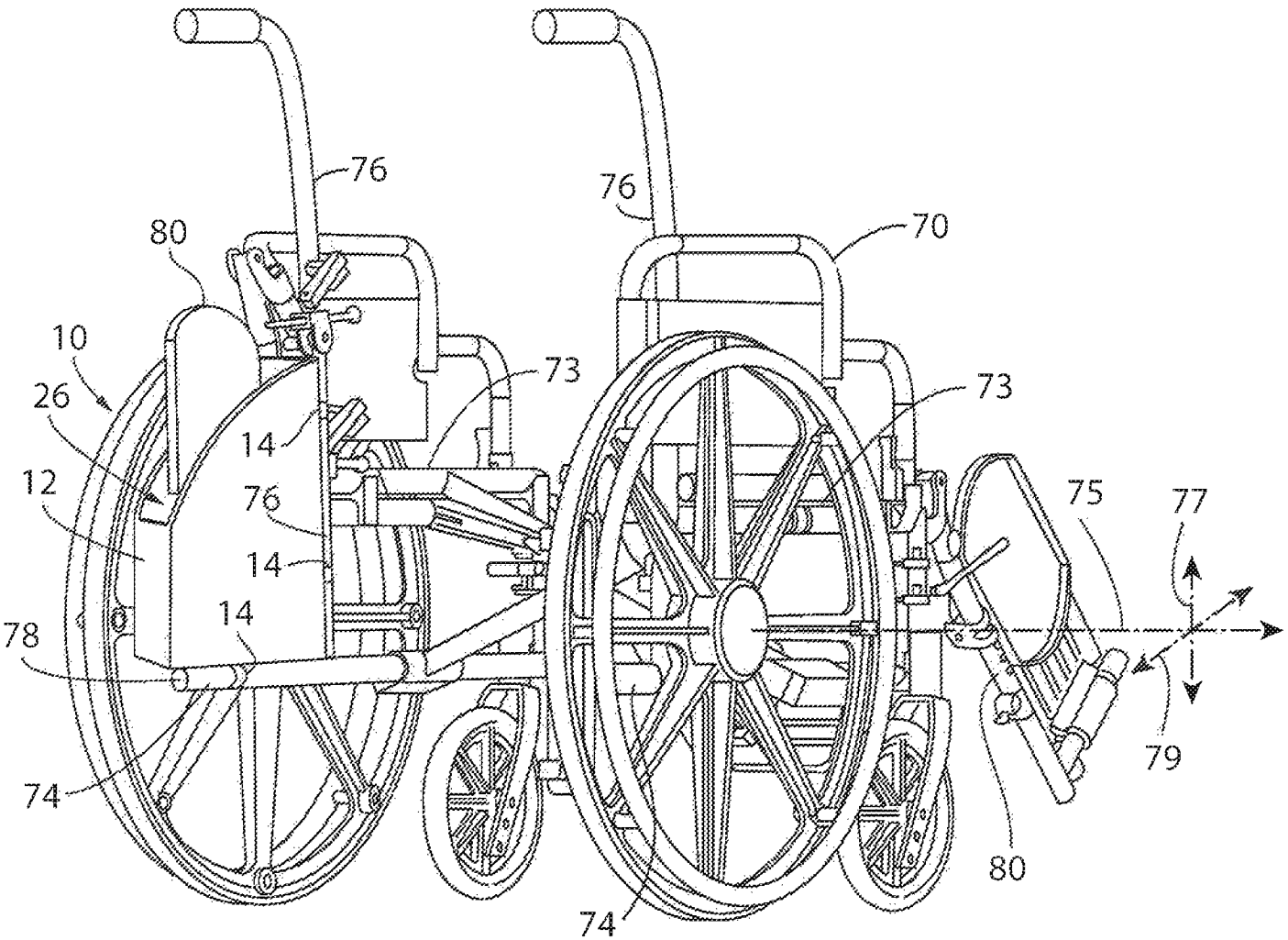
FIG. 7 is rear perspective view of a collapsible wheelchair frame to which a rigging carrier in accordance with one embodiment of the present invention has been affixed, and in which a leg rigging is retained.

Still referring to FIG. 1, collectively, the walls 16, 18, 20, 22 and bottom 24 generally form a four-sided box with a base, having an exposed top side that may extend towards the front side, as is shown in the illustrated embodiment that includes a relatively shorter front wall 22 providing a partial fifth side to the box. The exposed front and top sides may facilitate ease of placement and retrieval of the rigging from within the receptacle's interior cavity 26. Referring briefly to FIG. 7, when in use, a portion of the rigging may extend above the walls 16, 18, 20, 22, of the receptacle 12 while maintaining a secure retention of the rigging.

Figure 3:
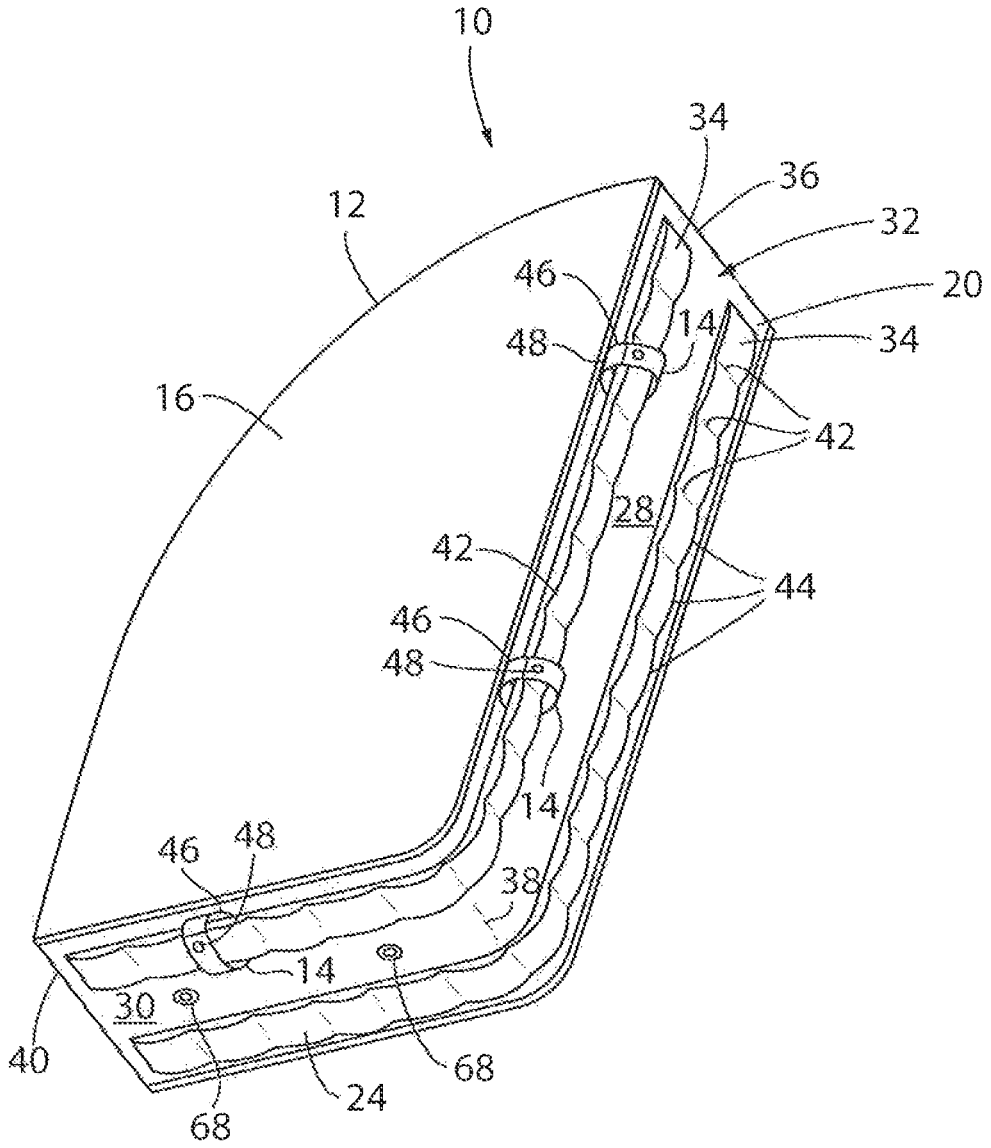
FIG. 3 is perspective view from the rear, side and bottom of the rigging carrier shown in FIG. 1.
Figure 5:
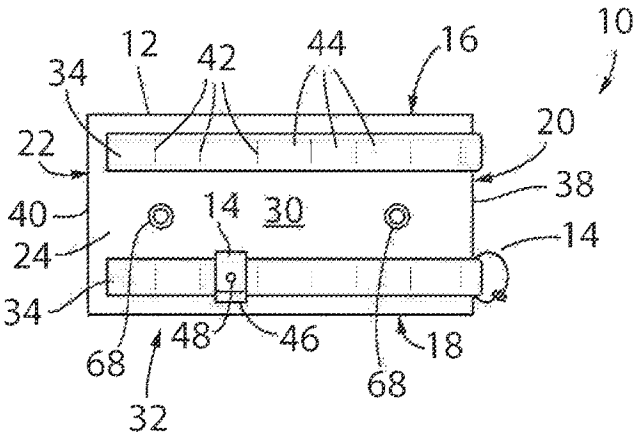
FIG. 5 is bottom plan view of the rigging carrier shown in FIG. 1.
Figure 4:
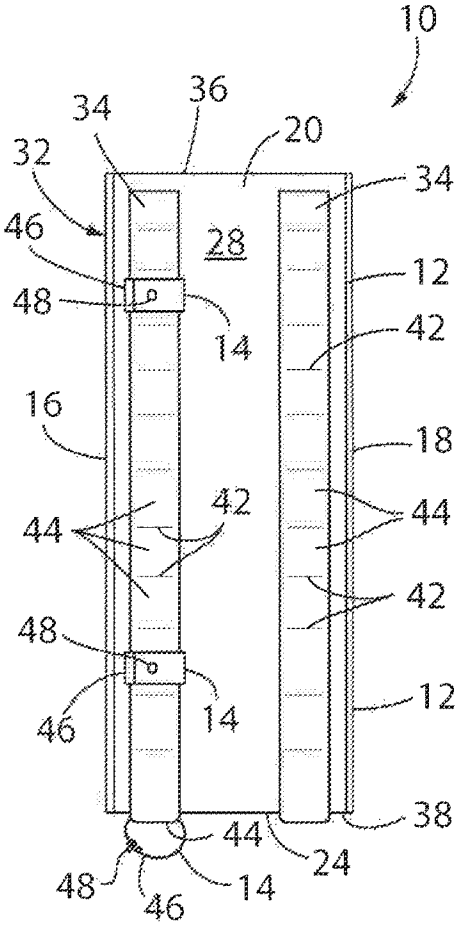
FIG. 4 is rear elevation view of the rigging carrier shown in FIG. 1.

Turning now to FIG. 2, an outer surface 28 of the rear wall 20 and the outer surface 30 of the bottom 24 of the receptacle 12 may also include an attachment mechanism 32 for engaging the mounting device 14 of the rigging carrier 10. In one embodiment, the attachment mechanism 32 may be one or more straps 34 that extends along the outer surfaces 28 and 30. The straps 34 may preferably extend from a top or first edge 36 of the rear wall 20 to a bottom or second edge 38 that also defines the rear edge of the bottom 24 of the receptacle 12. The straps 34 may curve around the second edge 38 and continue to the third edge 40, located at the front of the bottom 24. The straps 34 may be intermittently affixed to the outer surfaces 28 and 30 at fixation points 42. In one embodiment the fixation points are sewn attachments. The distance between adjacent fixation points 42 along the length of the straps 34 define attachment points 44 for receiving a mounting device 14. In one embodiment of the present invention, each strap 34 may include approximately between 10 and 20, and more preferably approximately 16 attachment points 44 for receiving a mounting device 14 along its length. The strap 34 may be formed of a fabric, such as a nylon webbing material with each fixation point 42 spaced approximately 1.0 to 2.0 inches apart. Referring briefly to FIGS. 3-5, the attachment mechanism 32 may include two straps 34 that are disposed along the outer surfaces 28, 30. The presence of two straps 24 allows a user to select the desired strap 34 in which to engage the mounting devices 14 for mounting the rigging carrier 10 in the distal most location available on a given wheelchair and maximize the closure of the wheelchair towards its fully collapsed configuration, particularly when two rigging carriers 10 are simultaneously mounted to the wheelchair. If desired, the user may also mount the rigging carrier 10 in a medial mounting configuration through use of the alternative strap 34, at the preference of the user.

Returning now to FIG. 2-5, the mounting devices 14 are shown engaging the strap 34. The mounting devices 14 are shown as a fabric loop 46 that each pass through an attachment points 44 on the strap 34. The fabric loops 46 are configured to open and close through the engagement of a releasably engageable fastener 48. In one embodiment the fastener 48 may be a hook and loop material disposed on opposing surfaces of the material forming the loop 46. Alternatively, the fastener 48 may be a snap, button or other similar closer mechanism. In one embodiment of the present invention, the mounting devices 14 are configured to securely engage both a variable attachment point 44 on the strap 34 and a portion of the wheelchair frame, as will be described in further detail below. To accommodate various wheel chair models, the mounting devices 14 may be selectively positioned along the length of the strap 34 to obtain the preferred mounting location. The fastener 48 is then closed once both the attachment point 44 on the strap 34 and a portion of the wheelchair frame have been encircled by the fabric loop 46. Preferably the selected attachment points 44 will include at least one attachment point 44 positioned on the outer surface 30 of the bottom 24 and at least one attachment point 44 positioned on the outer surface 28 of the rear wall 20. In this configuration, the one or more mounting devices 14 at the bottom 24 will ensure that the weight of the rigging carrier 10 and rigging is supported by the wheelchair frame from below the bottom 24, namely, affixing the carrier 10 to the horizontal tube 74, i.e., anti-tip bar, of the wheelchair. The one or more mounting devices 14 at the rear wall 20 of the carrier 10 will inhibit undesirable lateral movement of the rigging carrier 10, by affixing the carrier 10 to the vertical tube 76 of the wheelchair. While the mounting devices 14 have been described above as fabric loops 46, it should be understood that other mounting devices 14 that are configured to engage both the attachment mechanism 32 and the frame of the wheelchair, such as clamps, threaded fasteners, etc., are considered well within the scope of the present inventions.

Figure 6:
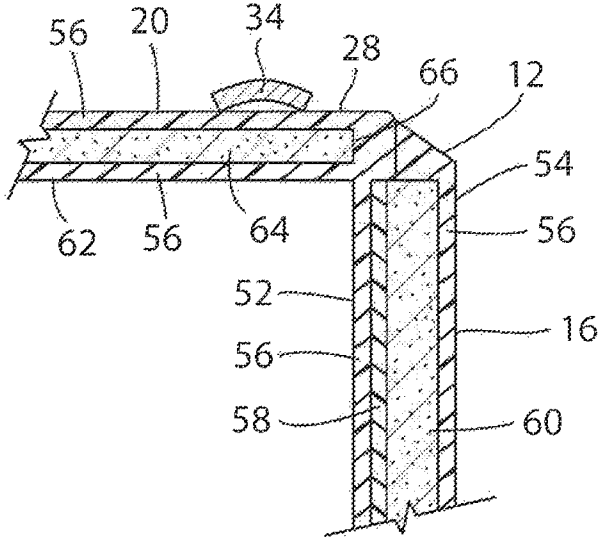
FIG. 6 is detailed cross sectional view of a corner between a rear wall and a side wall of the rigging carrier shown in FIG. 1.

Turning now to FIG. 6, a corner between the side wall 16 and rear wall 20 is shown along a latitudinal cross section. Referring first to the side wall 16, which is similar in construction to opposing side wall 18, the inner surface 52 and outer surface 54 of the side wall 16 are both formed of a covering 56. In one embodiment of the present invention, the covering 56 may be a fabric, such as a 1000 denier nylon, which provides durability, flexibility and water resistance to the exposed inner and outer surfaces 52, 54 of the side wall 1 16. The covering 56 may be formed of other materials such as woven fabrics, polyester, nylons, etc. The inner core of the side wall 16 may be formed of two laminated components, including a semirigid first layer 58 and a relatively softer second layer 60. The first layer 58 may be formed of a substrate that provides rigidity for the side wall 16 and is relatively light weight, such as a corrugated plastic, plastic hex board, plastic sheet, etc., for example, a Coroplast® plastic sheet commercially available from Inteplast Group of New Jersey USA. Preferably, the substrate material of the first layer 58 is also water resistant and non-absorbent, allowing the carrier 10 to be washed without damage to the structural integrity of the carrier 10. The second layer 60 may be formed of a lightweight resilient material such as closed cell or open cell foam formed of polyurethane or polyethylene, which provides cushioning to the outer surface 54 of the side wall 16. Again, in one embodiment, the second layer 60 is water resistant and non-absorbent to allow the carrier 10 to be washed or otherwise contact water. The second lay 60 may be affixed to one surface of the first layer 58, or both opposing surfaces of the first layer. It should be further understood that while the preceding discussion is directed to the side wall 16, it may equally apply to the construction of the opposing side wall 18 and bottom 24.

Turning now to rear wall 20, the inner surface 62 and outer surface 28 are similarly formed of covering 56 as was described above. The inner core of the rear wall 20 is shown as a single layer 64 of a lightweight resilient material such as closed cell or open cell foam formed of polyurethane or polyethylene, which provides cushioning to the other outer rear wall 20 and allows the rear wall to collapse and expand. That is to say that the absence of a semirigid layer in the rear wall 20 (and corresponding front wall 22) allows the receptacle 12 to laterally expand and contract when receiving a rigging in the cavity 26 and ensure a secure fit thereof. Again, the single layer 64 is preferably water resistant and non-absorbent to allow the carrier 10 to be washed or otherwise contact water. It should be further understood that while the preceding discussion is directed to the rear wall 20, it may equally apply to the construction of the opposing front wall 22 and possibly the bottom 24.

The seams 66, which join both the coverings 56 and the walls 16, 18, 20, 22, 24 are stitched and may include a super imposed, lapped, bound, or flat seam. The seams 66 may also include piping to provide enhanced strength to the seams 66.

As was discussed above, the materials that form the covering 56 and inner core layers 58, 60, 64 of the receptacle 12 may be water resistant and non-absorbent materials to allow for washing of the carrier 10. Additionally, as shown in FIG. 5, the bottom 24 of the receptacle 12 may include one or more apertures, i.e., drain grommets 68, that extend through the bottom 24 and allow water to drain out of the inner cavity 26.

Figure 9:
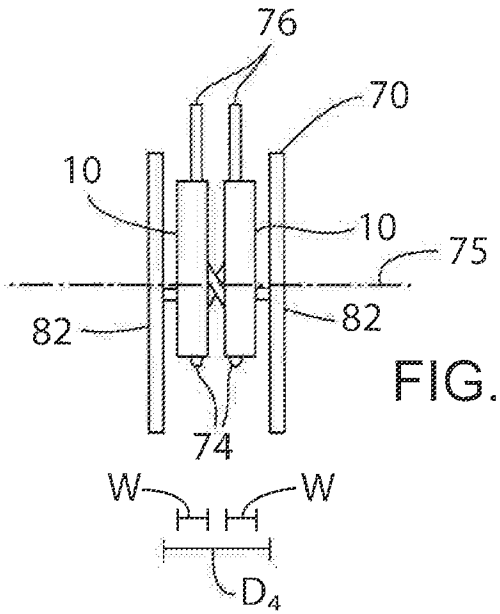
FIG. 9 is a representative rear view of a wheelchair frame in a collapsed configuration to which two rigging carriers in accordance with one embodiment of the present invention have been affixed.
Figure 8:
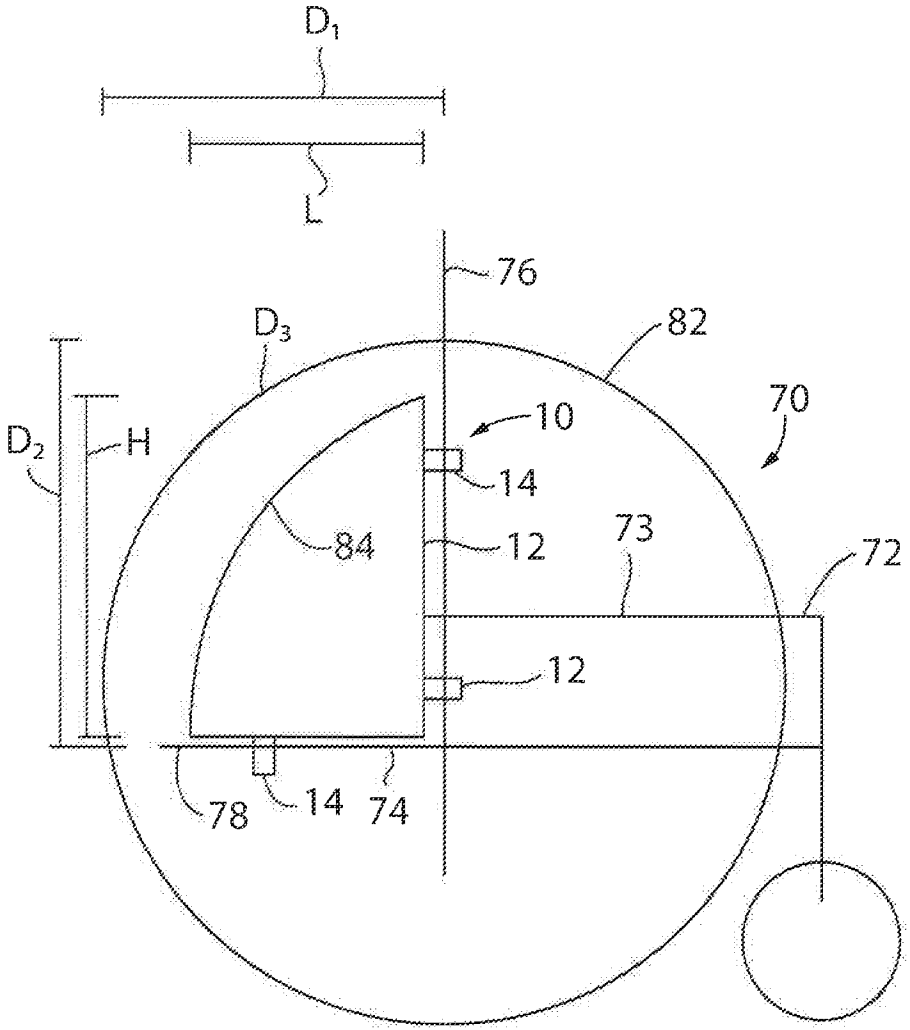
FIG. 8 is a representative side view of a wheelchair frame to which a rigging carrier in accordance with one embodiment of the present invention has been affixed.

Turning now to FIGS. 7-9, and initially FIG. 7, the carrier 10 is shown in use where it has been attached to a wheelchair 70. More specifically, the folding or collapsible wheelchair 70 includes a frame 72 that has in part, a horizontal tube 74 and a vertical tube 76 on each side and a seating surface 73. A wheel 82 is attached to the frame 72 adjacent left and right transversely opposed sides of the seating surface 73 such that the wheels 82 rotate about at least one transversely extending axis 75 extending beneath the seating surface 73. The vertical tube 76 defines the mounting location for the back rest of the wheelchair 70, and extends downwardly about a vertical axis 77 below the level of the seating surface attachment bar 73, where it is exposed and provides a mounting location for the mounting devices 14 at the rear wall 20 of the receptacle. The horizontal tube 74 or anti-tip bar extends generally perpendicular from and near the bottom end of the vertical tube 76 and extends rearwardly therefrom about a longitudinal axis 79. The end 78 of horizontal tube 74 is provided for a mounting location for tip-prevention wheels, or rollers, as well as provides a step surface for a user to leverage the wheelchair 70 over a curb or the like. When used in combination with the caddie 10, the horizontal tube 74 provides a mounting location for the mounting devices 14 at the bottom 24 of the receptacle 12 and supports the majority of the weight of both the carrier 10 and the folded leg or footplate rigging 80 that has been stored within the cavity 26 of the carrier 10. The removable leg or footplate rigging 80 may be positioned so that it is stabilized against the wall of the receptacle 12 supported on the horizontal tube 74 preventing the vertically rising portions of the rigging 80 from falling backward with respect to direction of the wheelchair 70. In one preferable embodiment, the end 78 of the horizontal tube 74 remains available for use as a mounting location for tip-prevention wheels and/or leverage step, as described above, when the caddie 10 is mounted to the wheelchair 70.

Turning now to FIG. 8, the cross-sectional view of the wheelchair 70 is shown including a repetitive frame 72 and wheel 82, and a rigging holder 10 mounted to the frame 72, as was previously described. As shown in FIG. 8, when mounted, the length "L" of the receptacle 12 is approximately less than 110% of the distance "$D_1$" extending from the vertical tube 76 to the most rearward edge of the wheel 82, and more preferably approximately less than the distance "$D_1$" or plus or minus 20 percent of this distance "$D_1$". Similarly, the height "H" of the receptacle 12 is approximately less than 110% of the distance "$D_2$" extending from the horizontal tube 74 to the top most edge of the wheel 82, and more preferably approximately less than the distance "$D_2$" or plus or minus 20 percent of this distance "$D_2$". Resultantly, the distant of the arcuate front edge 84 of the receptacle 12 is approximately less than 110% of the arcuate length "$D_3$" of the wheel 82 that extends between a first point that intersects the vertical tube 76 and a second point that would intersect the horizontal tube 74, and more preferably the arcuate front edge 84 is less than the arcuate length "$D_3$". In this way the receptacle 12 and its contents are shielded by the wheels 82 from typical glancing contact with walls or the like.

In one embodiment of the present invention, the arcuate front edge 84 of the receptacle 12 has a length of approximately between 9.0 inches and 15.0 inches, and preferably approximately 12.75 inches. In this configuration, the arcuate front edge 84 of the receptacle 12 generally conforms to the outer edge of the wheel 82, such that the carrier 10 does not extend substantially radially outwardly of the outer perimeter of the wheel 82. As such, the carrier 10 is shielded from most contact by the wheelchair wheel 82. More preferably, the carrier 10 does not extend radially outwardly of the outer perimeter of the wheel 82. Furthermore, generally the arcuate front edge 84 of the receptacle 12 may generally align with the curvature of the wheel 82, as shown in FIG. 8. However, it should be understood that wheelchair 70 dimensions, frame 72 construction, and wheel 82 size may vary amongst manufactures and models. By way of one non limiting example, a representative wheelchair 70, such as the Tracer EX2™ manufactured by Invacare of Elyria, Ohio has a wheel 82 diameter of approximately 24 inches and has an unfolded width of between 16 inches to 10 inches, and a folded width of approximately 13 inches.

Lastly, turning to FIG. 9, when in use, the wheelchair 70 is configured to fold or collapse inwardly in a space saving storage configuration. As was previously described, the width of the receptacle 12 may be sufficiently narrow as to prevent the receptacle 12 from impeding or inhibiting the folding mechanism of a conventional collapsible wheelchair. As shown in FIG. 9, in a folded configuration, the wheelchair 70 provides an internal width "$D_4$" that extends from the inner surface of one wheel 82 to the inner surface of the opposing wheel 82. The two mounted carriers 10 each preferably exhibit a width "W" that is less than or equal to one half of the internal width "D4", i.e., D4/2. In such an embodiment, mounting of two carriers 10 would not inhibit closure or folding of the wheelchair 70.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A wheelchair assembly comprising:

a collapsible frame providing a seating surface receiving a seated individual;

a first and second wheel attached to the frame at left and right transversely opposed sides of the seating surface to rotate about at least one transversely extending axis beneath the seated individual, the first and second wheel positioned for rotation by the seated individual;

at least one removable footplate rigging extending forwardly with respect to the seating surface for supporting a foot of the seated individual;

at least one anti-tip bar extending rearwardly along a longitudinal axis limiting rearward tipping of the seating surface about the at least one transversely extending axis;

at least one rigging receptacle supported by at the least one anti-tip bar for receiving at least one of the removable footplates there; and wherein the collapsible frame has a first distance between an inner surface of the first wheel and the inner surface of the second wheel when the collapsible frame is in a collapsed configuration, and wherein the at least one receptacle has an outer width less than or equal to 60 percent of the first distance.

2. The assembly of claim 1, wherein the frame provides at least one upwardly extending bar supporting a rear of the seating surface and wherein the rigging receptacle is further supported by the at least one upwardly extending bar.

3. The assembly of claim 2, wherein the rigging receptacle provides for releasable straps releasably attaching the rigging receptacle to the anti-tip bar and upwardly extending bar.

4. The assembly of claim 1, wherein the rigging receptacle provides a flexible sleeve open at an upper end.

5. The assembly of claim 1, wherein the rigging receptacle provides a fabric material holding a non-fabric stiffener.

6. The assembly of claim 5, wherein the non-fabric stiffener comprises a semirigid core disposed within a foam pad.

7. The assembly of claim 5, wherein the fabric material is a fluid resistant nylon fabric.

8. The assembly of claim 1, wherein the at least one receptacle provides a first receptacle supported by a first anti-tip bar of the collapsible frame and a second receptacle supported by a second anti-tip bar of the collapsible frame.

9. The assembly of claim 1, wherein the at least one receptacle provides two opposing side walls, a rear wall extending between the two opposing side walls, a base extending between a lower edge of the walls, and an interior cavity defined between an inner surface of the walls and the base, wherein the inner cavity has a width approximately equal to a width of the at least one removable footplate rigging.

10. The assembly of claim 9, wherein the at least one receptacle further comprises at least one fluid drain grommet extending through the base of the receptacle.

11. The assembly of claim 9, wherein the at least one receptacle has an outer width of between 2.0 and 5.0 inches.

12. The assembly of claim 9, wherein the at least one receptacle has an outer depth of between 6.0 to 15.0 inches.

13. The assembly of claim 9, wherein the rear wall of the at least one receptacle has a height of between 10.0 to 24.0 inches.

14. A wheelchair rigging receptacle and wheelchair assembly, the wheelchair comprising:

a frame having first side and an opposing second side;

a first wheel rotatably affixed at a first side of the frame and a second wheel rotatably affixed at a second side of the frame;

the first side of the frame having a first vertical tube and a first horizontal tube extending rearwardly of the first vertical tube;

the second side of the frame having a second vertical tube and a second horizontal tube extending rearwardly of the second vertical tube; and wherein the at least one receptacle has an outer width less than or equal to 60 percent of the first distance a seating surface extending between the first and second sides of the frame;

an appendage support rigging releasably affixed to the frame; and, at least one receptacle configured to retain the appendage support rigging therein when the appendage support rigging is not affixed to the frame, the receptacle having:

two opposing side walls, a rear wall extending between the two opposing side walls, and a base extending between a lower edge of the walls;

an interior cavity defined between an inner surface of the wall and the base, wherein the interior cavity has a width approximately equal to a width of the appendage support rigging;

an outer width less than or equal to one half of a distance between an inner surface of the first wheel and an inner surface of the second wheel of the wheelchair when the wheelchair is in a collapsed configuration; and, at least one mounting device configured to affix the receptacle to the frame.

15. The assembly of claim 14, wherein at least one mounting device comprises a first mounting device configured to secure the base to the first or second horizontal tube of the frame at a first mounting position that is variable over a length of the base.

16. The assembly of claim 15, wherein at least one mounting device comprises a second mounting device configured to secure the rear wall of the receptacle to the first or second vertical tube of the frame at a second mounting position that is variable over a height of the rear wall.

17. The assembly of claim 14, wherein the receptacle further comprises a front wall opposite the rear wall, and wherein a height of the front wall is less than a height of the rear wall.

18. The assembly of claim 17, wherein the two opposing side walls provide a semirigid core disposed within a foam pad.

* * * * *